US008310420B2

(12) United States Patent
Kwon et al.

(10) Patent No.: US 8,310,420 B2
(45) Date of Patent: Nov. 13, 2012

(54) ORGANIC LIGHT EMITTING DISPLAY DEVICE

(75) Inventors: Ae-Kyung Kwon, Suwon-si (KR); Se-Ho Kim, Suwon-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 914 days.

(21) Appl. No.: 12/381,457

(22) Filed: Mar. 11, 2009

(65) Prior Publication Data

US 2009/0284454 A1 Nov. 19, 2009

(30) Foreign Application Priority Data

May 13, 2008 (KR) ..... 10-2008-0043971

(51) Int. Cl.
*G09G 3/32* (2006.01)

(52) U.S. Cl. ..... 345/82; 345/76; 315/169.1

(58) Field of Classification Search ..... 345/76–83, 345/207; 315/169.1–169.4
See application file for complete search history.

(56) References Cited

U.S. PATENT DOCUMENTS

| | | | | |
|---|---|---|---|---|
| 2005/0030214 | A1 | 2/2005 | Jo | |
| 2008/0088648 | A1 * | 4/2008 | Nathan et al. | 345/690 |
| 2008/0122819 | A1 * | 5/2008 | Cho et al. | 345/205 |
| 2008/0204375 | A1 * | 8/2008 | Shin et al. | 345/76 |
| 2009/0033685 | A1 * | 2/2009 | Park et al. | 345/690 |

FOREIGN PATENT DOCUMENTS

| | | | |
|---|---|---|---|
| JP | 2000-100954 | | 4/2000 |
| JP | 2001-035655 | A | 2/2001 |
| JP | 2005-035655 | A | 2/2001 |
| JP | 2005-141062 | A | 6/2005 |
| JP | 2005-173184 | A | 6/2005 |
| JP | 2005-182049 | A | 7/2005 |
| JP | 2005-215037 | A | 8/2005 |
| JP | 2006-118965 | | 5/2006 |
| JP | 2007-079585 | A | 3/2007 |
| JP | 2008-032729 | | 2/2008 |
| KR | 10-2005-0036246 | A | 4/2005 |
| KR | 10-2005-0058015 | A | 6/2005 |
| KR | 1020070102891 | | 10/2007 |
| KR | 1020070102893 | | 10/2007 |
| WO | WO 03/050602 | A1 | 6/2003 |

OTHER PUBLICATIONS

Japanese Office Action dated Jun. 14, 2011 for Japanese Patent Application No. JP 2008-203552 which shares priority of Korean Patent Application No. KR 10-2008-0043971 with captioned U.S. Appl. No. 12/381,457.

(Continued)

*Primary Examiner* — Kimnhung Nguyen
(74) *Attorney, Agent, or Firm* — Knobbe Martens Olson & Bear, LLP

(57) ABSTRACT

An organic light emitting display device capable of stabilizing the output of an external condition detection sensor is disclosed. The organic light emitting display device has an external condition detection sensor configured to sense an external condition and to output a detection signal to be used for adjusting the display parameters according to the external condition. The display device also has a sensor output stabilizing unit coupled to an output line of the external condition detection sensor, which is configured to compensate for parasitic coupling of signals onto the detection signal.

20 Claims, 2 Drawing Sheets

OTHER PUBLICATIONS

Office Action corresponding to Korean Application No. 10-2008-0043971 dated Aug. 28, 2009.

Japanese Office Action dated Oct. 18, 2011 for Japanese Patent Application No. JP 2008-203552 which shares priority of Korean Patent Application No. KR 10-2008-0043971 with captioned U.S. Appl. No. 12/381,457.

Office Action of European Patent Application No. 091570770.0 dated Jun. 4, 2009.

* cited by examiner

ORGANIC LIGHT EMITTING DISPLAY DEVICE

CROSS-REFERENCE TO RELATED APPLICATION

This application claims priority to and the benefit of Korean Patent Application No. 10-2008-0043971, filed on May 13, 2008, in the Korean Intellectual Property Office, the entire content of which is incorporated herein by reference.

BACKGROUND

1. Field

The field relates to an organic light emitting display device, and more particularly to an organic light emitting display device capable of stabilizing the output of an external condition detection sensor.

2. Description of the Related Technology

In recent years, various flat panel displays have been developed. The flat panel displays are light-weight and small-sized, when compared to cathode ray tubes. Particularly, among the flat panel display devices, the organic light emitting display device is favored with excellent luminance and color purity. The organic light emitting display uses an organic compound as a light emitting material.

An organic light emitting display device is thin and light-weight and may be driven with low power consumption, and therefore it has been expected to be widely used in the field of portable display devices, etc.

However, a portable display device in which the organic light emitting display device is mounted may be exposed to various external environments. Therefore, the organic light emitting display device may have different visibilities according to the external conditions such as the intensity of ambient light, the ambient temperature, etc.

Therefore, it is necessary to adjust the output luminance of the organic light emitting display device according to the external conditions so as to provide visibility that is suitable for the user and prevent excessive light emission of the organic light emitting display.

For this purpose, an external condition detection sensor may be provided in the organic light emitting display device to output a detection signal by sensing the external conditions and control drive circuits according to the detection signal.

However, the output of the external condition detection sensor may be a small current signal. For example, when the external condition detection sensor is composed of a light detection sensor unit to correspond to the intensity of ambient light, a light detection sensor unit may output a light detection signal having a small current value.

Such an output of the external condition detection sensor is easily affected by noise from peripheral circuits or signal lines. Therefore, it is difficult to accurately adjust the output luminance of the organic light emitting display device to a reliable luminance level that corresponds to the external conditions because the output of the external condition detection sensor is unstable.

SUMMARY OF CERTAIN INVENTIVE ASPECTS

One aspect is an organic light emitting display device. The device includes a pixel unit including a plurality of pixels disposed near intersection points of scan lines, light-emitting control lines and data lines, a scan driver configured to supply a scan signal and a light-emitting control signal to the scan lines and the light-emitting control lines, respectively, a data driver configured to supply a data signal to the data lines, an external condition detection sensor configured to sense external conditions and to output a detection signal according to the external conditions, and a sensor output stabilizing unit coupled to one or more output lines of the external condition detection sensor. The sensor output stabilizing unit includes an inverter coupled between one of input and output lines of the scan driver which crosses the one or more output lines of the external condition detection sensor, and one of the output lines of the external condition detection sensor, and a capacitor coupled between an output line of the inverter and the one or more output lines of the external condition detection sensor.

Another aspect is an organic light emitting display device. The device includes a pixel unit configured to be driven according to a signal on a signal line, an external condition detection sensor configured to sense an external condition and to output a detection signal according to the external condition, and a sensor output stabilizing unit coupled to an output line of the external condition detection sensor, the output line crossing the signal line, where the sensor output stabilizing unit includes an inverter coupled to the signal line, and a capacitor coupled between an output line of the inverter and the output line.

Another aspect is an organic light emitting display device. The device includes a pixel unit configured to be driven according to a signal on a signal line, an external condition detection sensor configured to sense an external condition and to output a detection signal according to the external condition on an output line, and a sensor output stabilizing unit coupled to the output line of the external condition detection sensor, the output line capacitively coupled to the signal line, where the sensor output stabilizing unit is configured to compensate for parasitic coupling of the signal onto the output line.

DETAILED DESCRIPTION OF CERTAIN INVENTIVE EMBODIMENTS

Figure 1:
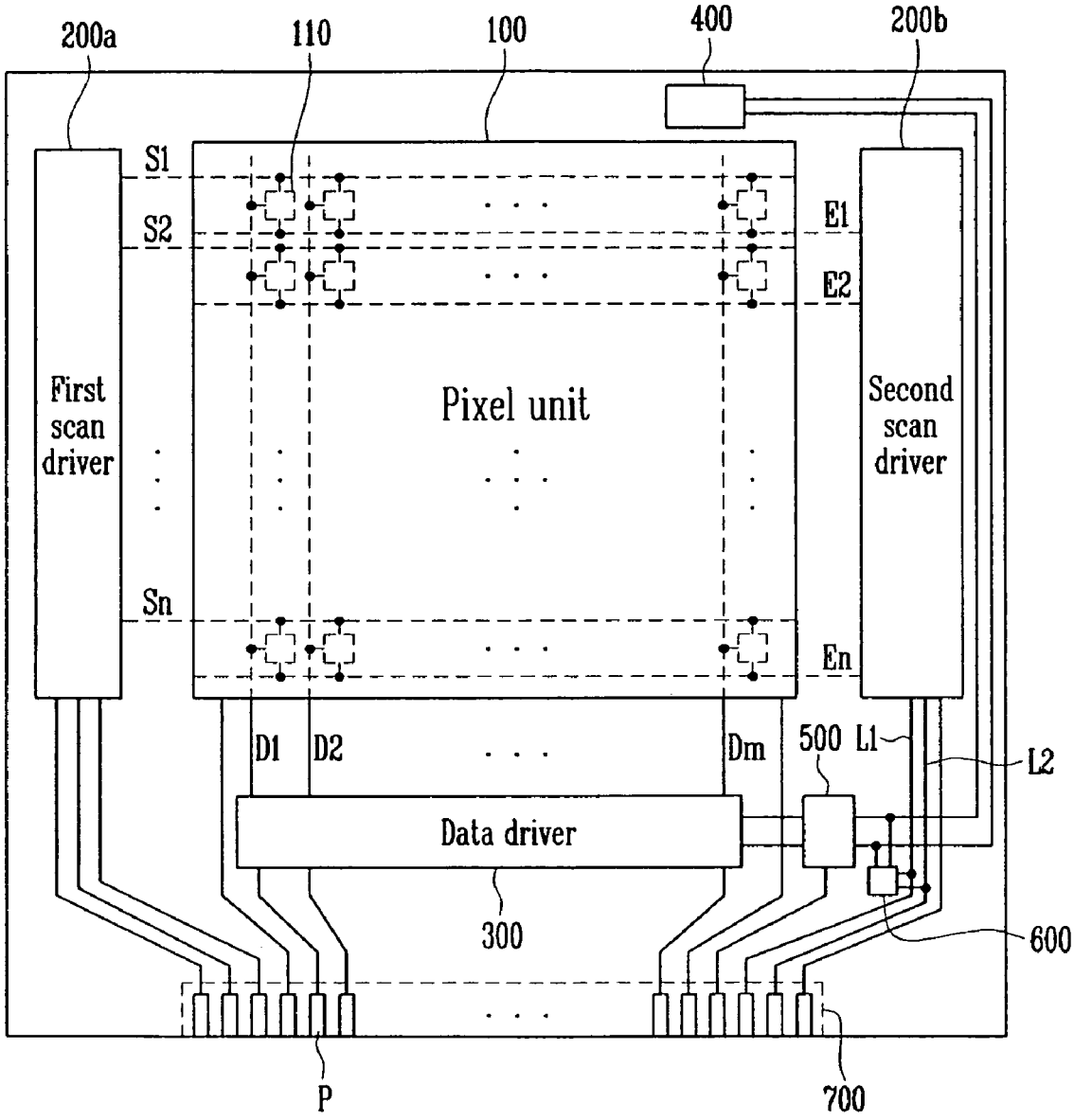
FIG. 1 is a plane view showing an organic light emitting display device according to one exemplary embodiment.

Hereinafter, certain exemplary embodiments will be described with reference to the accompanying drawings. When a first element is described as being coupled to a second element, the first element may not be directly coupled to the second element but may be indirectly coupled to the second element via a third element. Further, some of the elements that are not essential to the complete understanding of the invention are omitted for clarity. Also, like reference numerals generally refer to like elements throughout.

FIG. 1 is a plane view showing an organic light emitting display device according to one exemplary embodiment.

Referring to FIG. 1, the organic light emitting display device includes a pixel unit 100, first and second scan drivers 200*a* and 200*b*, a data driver 300, an external condition detection sensor 400, a sensor output amplifier unit 500, a sensor output stabilizing unit 600, and a pad unit 700.

The pixel unit 100 includes a plurality of pixels 110 disposed near intersection points of scan lines (S1 to Sn), light-emitting control lines (E1 to En) and data lines (D1 to Dm).

Pixel unit 100 receives a scan signal, a light-emitting control signal and a data signal from the scan lines (S1 to Sn), the light-emitting control lines (E1 to En) and the data lines (D1 to Dm), respectively. Also, the pixel unit 100 further receives first and second pixel power sources (ELVDD and ELVSS) through the pad unit 700. Pixel unit 100 displays an image according to the scan signal, the light-emitting control signal, the data signal, and the first and second pixel power sources (ELVDD and ELVSS).

In this embodiment, the first and second scan drivers 200*a* and 200*b* generate a scan signal and a light-emitting control signal according to the scan drive control signal supplied from the pad unit 700.

For example, the first scan driver 200*a* may receive a start pulse and a clock signal, an output enable signal and the like from the pad unit 700 to generate a scan signal, and generate a scan signal according to the received signals. The scan signal generated in the first scan driver 200*a* is subsequently supplied to the scan lines (S1 to Sn).

Also, the second scan driver 200*b* may receive a start pulse, a clock signal and the like from the pad unit 700 to generate a light-emitting control signal, and generate a light-emitting control signal according to the received signals. The light-emitting control signal generated in the second scan driver 200*b* is subsequently supplied to the light-emitting control lines (E1 to En).

Meanwhile, the two scan drivers 200*a* and 200*b* are disposed on either side of the pixel unit 100 to supply a scan signal and a light-emitting control signal to the scan lines (S1 to Sn) and the light-emitting control lines (E1 to En) respectively, as shown in FIG. 1, but the present invention is not limited thereto.

For example, one scan driver may generate both a scan signal and a light-emitting control signal, or may generate only a scan signal without generating a light-emitting control signal. Also, when the scan drivers are provided on both sides of the pixel unit 100, the scan driver provided on one side of the pixel unit 100 may generate some of a scan signal and a light-emitting control signal, and the scan driver provided on the other side of the pixel unit 100 may generate the remainder of the scan signal and light-emitting control signals.

The data driver 300 generates a data signal according to a data drive control signal and data supplied from the pad unit 700. The data signal generated in the data driver 300 is supplied to the data lines (D1 to Dm). In addition, the data driver 300 may be set to control the output luminance of the pixel unit 100 according to a detection signal output from the external condition detection sensor 400. For example, the data driver 300 may control a voltage level of a data signal according to the detection signal in the case of a voltage drive method. Additionally or alternatively, the data driver 300 may control the current of the data signal according to the detection signal, for example, in the case of a current drive method.

The external condition detection sensor 400 senses external condition, and outputs a detection signal corresponding to the external conditions.

For example, the external condition detection sensor 400 may have a light detection device to sense the intensity of ambient light, and output a light detection signal corresponding to the intensity of ambient light. Also, the external condition detection sensor 400 may have a temperature detection device to sense an ambient temperature, and include a temperature detection sensor unit to output a temperature detection signal corresponding to the ambient temperature.

For convenience' sake, this exemplary embodiment is described such that the external condition detection sensor 400 has a light detection sensor unit and a temperature detection sensor unit. In this case, the external condition detection sensor 400 may be designed to output a light detection signal and a temperature detection signal separately.

The sensor output amplifier unit 500 is coupled between the external condition detection sensor 400 and the data driver 300. The sensor output amplifier unit 500 includes an amplifier circuit for amplifying a current value (or, a voltage value) of the detection signals from the external condition detection sensor 400. That is to say, the sensor output amplifier unit 500 amplifies the detection signal supplied from the external condition detection sensor 400 and supplies the amplified detection signal to the data driver 300.

The sensor output stabilizing unit 600 is coupled to an output line of the external condition detection sensor 400. The output stabilizing unit 600 is provided to stabilize the output of the external condition detection sensor 400, because the output line of the external condition detection sensor 400 is in a high-impedance state.

More particularly, the output of the external condition detection sensor 400 may be a small current value (for example, a current value of about 100 nA or less). In this case, a separate power source is not connected to the output line of the external condition detection sensor 400, and the output line of the external condition detection sensor 400 is in a high-impedance state when the small electric current is output. In this case, the detection signal may be affected by peripheral circuits or other signal lines.

In particular, the external condition detection sensor 400 and the sensor output amplifier unit 500 may be provided in a panel of the organic light emitting display device in consideration of the unit price. In this case, an output line of the external condition detection sensor 400 may be disposed so that the output line crosses at least some input lines and/or output lines (hereinafter, referred to as input/output lines) of the first and/or second scan drivers 200*a* and 200*b*. The input lines of the first and/or second scan drivers 200*a* and 200*b* includes lines for supplying a start pulse, a clock signal and/or driver power sources to drive the first and/or second scan drivers 200*a* and 200*b*. The output lines of the first and/or second scan drivers 200*a* and 200*b* may include lines for outputting a scan signal and/or a light-emitting control signal (for example, a scan signal and/or a light-emitting control signal of the last terminal), which are outputted from the first and/or second scan drivers 200*a* and 200*b*, through the pad unit 700, and test the scan signal and/or the light-emitting control signal.

For example, since the first and/or second scan drivers 200*a* and 200*b* are disposed on both sides (the left and right sides as shown in FIG. 1) of the panel of the organic light emitting display device, the external condition detection sensor 400 and the sensor output amplifier unit 500 may be provided in upper and/or lower sides, away from the first and second drivers 200*a* and 200*b*. Particularly, the external condition detection sensor 400 and the sensor output amplifier unit 500 may be disposed respectively in the upper and lower sides of the panel in consideration of the sizes of the external condition detection sensor 400 and the sensor output amplifier unit 500 and the spaces formed in the upper and lower sides of the panel.

In this case, the sensor output amplifier unit 500 may be disposed on one side of the data driver 300 to reduce a distance to the data driver 300 and to facilitate the measurement of characteristics of an output terminal. For example, the sensor output amplifier units 500 may be disposed in a lower side of the second scan driver 200*b*, as shown in FIG. 1.

However, the output lines of the external condition detection sensor 400 coupled from the external condition detection sensor 400 to the sensor output amplifier unit 500 may be formed so that the output lines of the external condition detection sensor 400 can cross the input/output lines of the second scan driver 200*b*. That is to say, parasitic capacitors may be formed between the output lines of the external condition detection sensor 400 and the output lines of the second scan driver 200*b*. Scan control signals for driving the second scan driver 200*b* is supplied to the input/output lines of the second scan driver 200*b*. For example, when the second scan driver 200*b* generates a light-emitting control signal, a light-emitting control start pulse, a first and second light-emitting control clock signal and an input power of the second scan driver 200*b* may be input through the input lines of the second scan driver 200*b*, respectively. A light-emitting control signal output to the last terminal of the second scan driver 200*b* may be output to the output lines of the second scan driver 200*b* to test the light-emitting control signal. That is to say, three input/output lines of the second scan driver 200*b* are shown in FIG. 1 for convenience' sake, but the number of the input/output lines may be widely varied according to the second scan driver 200*b*.

Similarly, some of the scan control signals and/or light-emitting control signals supplied to the input/output lines of the second scan driver 200*b* may affect the detection signal output to the output lines of the external condition detection sensor 400, and change the detection signal.

In particular, alternating scan control signals and/or light-emitting control signals whose voltage levels repeatedly change may change the detection signal due to the coupling of the parasitic capacitor. For example, the start pulse of the light-emitting control signal input to the input line of the second scan driver 200*b*, and the light-emitting control signal output to the output line of the second scan driver 200*b* may couple onto the detection signal line.

In order to reduce the effect of the coupling, a sensor output stabilizing unit 600 is connected to some of the input/output lines, of the input/output lines of the second scan driver 200*b*. The input/output lines are disposed so that they overlap the output line of the external condition detection sensor 400, and the output line of the external condition detection sensor 400. Some of the input/output lines are represented by L1 and L2, as shown in FIG. 1.

Some embodiments of the sensor output stabilizing unit 600 include at least an inverter and a capacitor to offset the changes in the voltage level caused by the coupling reaction, and further description thereof will given below.

The pad unit 700 includes a plurality of pads (P) coupled to external drive circuits (not shown). Such a pad unit 700 transmits, for example, driver power sources and/or drive signals, supplied from each of the pads (P), to the panel. For example, the pad unit 700 may supply the driver power sources and/or drive signals, supplied from each of the pads (P), into the pixel unit 100, the first and second scan drivers 200*a* and 200*b*, the data driver 300, the external condition detection sensor 400, the sensor output amplifier unit 500 and/or the sensor output stabilizing unit 600.

As described above, the organic light emitting display device of FIG. 1 is configured to compensate for the changes in the detection signal caused by the coupling of the overlapped signal lines by coupling the sensor output stabilizing unit 600 to the output line of the external condition detection sensor 400.

Therefore, the organic light emitting display device that may reliably cope with the changes in the external conditions may be provided because the output of the external condition detection sensor 400 is stable.

Meanwhile, FIG. 1 shows that the sensor output amplifier unit 500 is disposed in a region below the second scan driver 200*b*, but the present invention is not limited thereto. For example, the sensor output amplifier unit 500 may be disposed in a region below the first scan driver 200*a*. In this case, the sensor output stabilizing unit 600 may be coupled to some of the input/output lines, of the first scan driver 200*a* because they overlap the output line of the external condition detection sensor 400.

Also, FIG. 1 shows that the external condition detection sensor 400 controls the data driver 300, but the present invention is not limited thereto. For example, the detection signal output from the external condition detection sensor 400 may be supplied to the first and/or second scan drivers 200*a* and 200*b* to control the pulse width of the scan signal and/or the light-emitting control signal that are generated in the first and/or second scan drivers 200*a* and 200*b*.

Figure 2:
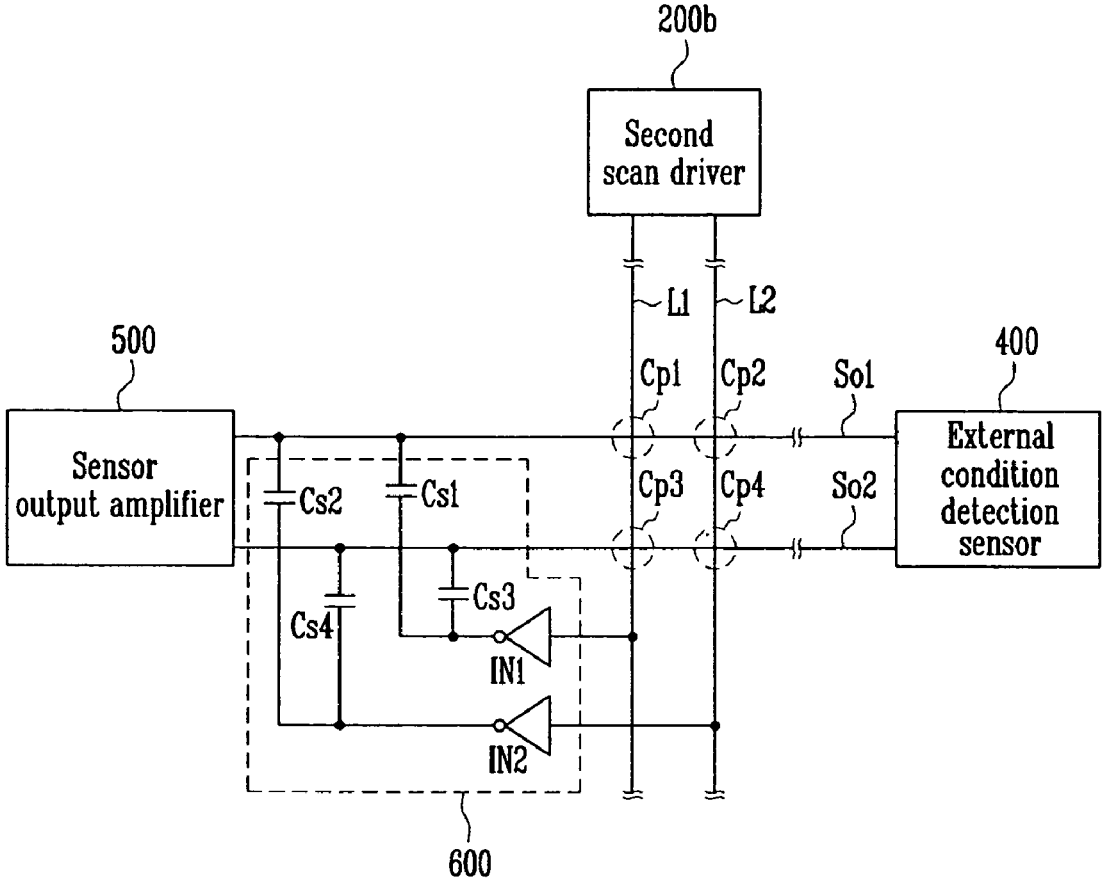
FIG. 2 is a circuit diagram showing a configuration of a sensor output stabilizing unit as shown in FIG. 1.
Figure 3:
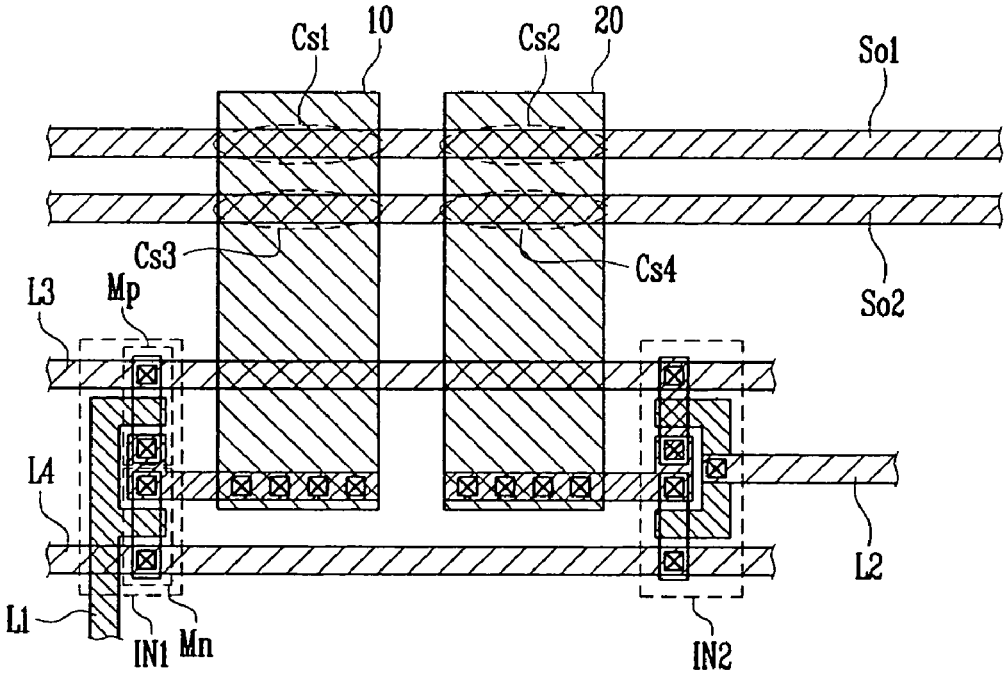
FIG. 3 is a plane view showing a layout of the sensor output stabilizing unit as shown in FIG. 2.

FIG. 2 is a circuit view showing an embodiment of a sensor output stabilizing unit as shown in FIG. 1. FIG. 3 is a plane view showing a layout of the sensor output stabilizing unit as shown in FIG. 2.

In this embodiment, the output lines of the external condition detection sensor 400 are first and second output lines (So1 and So2), shown in FIGS. 2 and 3. In addition, a first detection signal (for example, a light detection signal) and a second detection signal (for example, a temperature detection signal) are output to the first and second output lines (So1 and So2) of the external condition detection sensor 400, respectively. Also, FIGS. 2 and 3 show that some of the input/output lines (L1 and L2) of the second scan driver 200*b* are disposed so that they cross the first and second output lines (So1 and So2) of the external condition detection sensor 400. For example, the first input/output line (L1) may, for example, be an input line for supplying a start pulse of a light-emitting control signal from the pad unit 700 to the second scan driver 200*b*. The second input/output line (L2) may, for example, be an output line for outputting at least one light-emitting control signal from the second scan driver 200*b* to the pad unit 700. However, this is merely illustrative in this exemplary embodiment for better understanding, and the present invention is not limited thereto.

Referring to FIGS. 2 and 3, the sensor output stabilizing unit 600 includes inverters (IN1 and IN2) and capacitors (Cs1 to Cs4), all of which are coupled between some of the input/output lines (L1 and L2) of the second scan driver 200*b* crossing the output lines (So1 and So2) of the external condition detection sensor 400. As shown, the inverters (IN1 and IN2) and the capacitors (Cs1 to Cs4) are coupled between the output lines (So1 and So2) of the external condition detection sensor 400, i.e., input ends of the sensor output amplifier unit 500, and some of the input/output lines (L1 and L2) of the second scan driver 200*b*.

More particularly, the first inverter (IN1) is coupled between the first input/output line (L1) of the second scan driver 200*b* and the first and second output lines (So1 and So2) of the external condition detection sensor 400. A first capacitor (Cs1) is coupled between the output line of the first inverter (IN1) and the first output line (So1) of the external condition detection sensor 400, and a third capacitor (Cs3) is coupled between the output line of the first inverter (IN1) and the second output line (So2) of the external condition detection sensor 400.

The first inverter (IN1) and the first capacitor (Cs1) compensate for the changes in a first detection signal coupled by the first parasitic capacitor (Cp1) formed between the first input/output line (L1) of the second scan driver 200*b* and the first output line (So1) of the external condition detection sensor 400. That is to say, although the first detection signal is changed by the coupling of the first parasitic capacitor (Cs1), the change in the first detection signal is at least partially canceled by an inverted signal generated by the first inverter (IN1) and the coupling of the first capacitor (Cs1) to the sensor output amplifier unit 500.

In addition, the first inverter (IN1) and the third capacitor (Cs3) compensate for the changes in the first detection signal coupled by the third parasitic capacitor (Cs3) in the same manner as described above, the third parasitic capacitor (Cs3) being formed between the first input/output line (L1) of the second scan driver 200*b* and the second output line (So2) of the external condition detection sensor 400.

The second inverter (IN2) is coupled between the second input/output line (L2) of the second scan driver 200*b* and the first and second output lines (So1 and So2) of the external condition detection sensor 400. The second capacitor (Cs2) is coupled between the output line of the second inverter (IN2) and the first output line (So1) of the external condition detection sensor 400, and the fourth capacitor (Cs4) is coupled between the output line of the second inverter (IN2) and the second output line (So2) of the external condition detection sensor 400.

The second inverter (IN2) and second capacitor (Cs2) compensate for the changes in the second detection signal coupled by the second parasitic capacitor (Cs2) formed between the second input/output line (L2) of the second scan driver 200*b* and the first output line (So1) of the external condition detection sensor 400. The second inverter (IN2) and the fourth capacitor (Cs4) compensate for the changes in the second detection signal coupled by the fourth parasitic capacitor (Cs4) formed between the second input/output line (L2) of the second scan driver 200*b*.

The sensor output stabilizing unit 600 as described above may be arranged, for example, as shown in FIG. 3.

More particularly, first to fourth capacitors (Cs1 to Cs4) may be formed using the first and second conductive layers 10 and 20 that are overlapped with the output lines (So1 and So2) of the external condition detection sensor 400. The first conductive layer 10 is coupled to the first inverter (IN1) whose input is coupled to the first input/output line (L1) of the second scan driver 200*b*. The second conductive layer 20 is coupled to the second inverter (IN2) whose input is coupled to the second input/output line (L2) of the second scan driver 200*b*. Here, L3 and L4 are supply lines through which first and second reference power sources of the inverters (IN1 and IN2) are supplied, respectively. In the embodiment of Figure the inverters (IN1 and IN2) each comprise one P-type and one N-type transistors (Mp and Mn), but in other embodiments, each of the inverters (IN1 and IN2) may include a plurality of P-type transistors and N-type transistors.

According to the exemplary embodiments as described above, the sensor output stabilizing unit 600 compensates for the changes in the detection signal outputted from the output lines (So1 and So2) of the external condition detection sensor 400. Therefore, the detection signal may be stably supplied to the sensor output amplifier unit 500.

While the present invention has been described in connection with certain exemplary embodiments, it is to be understood that the invention is not limited to the disclosed embodiments, but, on the contrary, is intended to cover various modifications and equivalent arrangements included within the spirit and scope of the invention.

What is claimed is:

1. An organic light emitting display device, comprising:

a pixel unit including a plurality of pixels disposed near intersection points of scan lines, light-emitting control lines and data lines;

a scan driver configured to supply a scan signal and a light-emitting control signal to the scan lines and the light-emitting control lines, respectively;

a data driver configured to supply a data signal to the data lines;

an external condition detection sensor configured to sense external conditions and to output a detection signal according to the external conditions; and a sensor output stabilizing unit coupled to one or more output lines of the external condition detection sensor, wherein the sensor output stabilizing unit comprises:

an inverter coupled between one of input and output lines of the scan driver which crosses the one or more output lines of the external condition detection sensor, and one of the output lines of the external condition detection sensor; and a capacitor coupled between an output line of the inverter and the one or more output lines of the external condition detection sensor.

2. The organic light emitting display device according to claim 1, further comprising a sensor output amplifier unit coupled between the external condition detection sensor and the data driver, wherein the inverter and the capacitor are coupled between an input of the sensor output amplifier unit and the input or output line of the scan driver.

3. The organic light emitting display device according to claim 1, wherein the input or output line of the scan driver is an input line configured to supply an alternating scan drive control signal to the scan driver.

4. The organic light emitting display device according to claim 3, wherein the input line is an input line configured to supply a start pulse of the light-emitting control signal to the scan driver.

5. The organic light emitting display device according to claim 1, wherein the input or output line of the scan driver is an output line configured to output an alternating scan signal or light-emitting control from the scan driver.

6. The organic light emitting display device according to claim 1, wherein the external condition detection sensor comprises a light detection sensor unit configured to sense the intensity of ambient light and to output a light detection signal corresponding to the intensity of ambient light.

7. The organic light emitting display device according to claim 1, wherein the external condition detection sensor comprises a temperature detection sensor unit configured to sense ambient temperature and to output a temperature detection signal corresponding to the ambient temperature.

8. The organic light emitting display device according to claim 1, wherein the external condition detection sensor comprises a plurality of detection sensor units having a plurality of output lines, the detection sensor units configured to sense a plurality of different external conditions and to output detection signals corresponding to the plurality of different external conditions, and wherein a plurality of inverters and capacitors are formed such that an inverter and a capacitor are coupled to each of the output lines.

9. The organic light emitting display device according to claim 1, wherein the detection signal output from the external condition detection sensor controls the data driver.

10. The organic light emitting display device according to claim 9, wherein the data driver controls at least one of a voltage level and a current value of the data signal according to the detection signal.

11. An organic light emitting display device, comprising:

a pixel unit configured to be driven according to a signal on a signal line;

an external condition detection sensor configured to sense an external condition and to output a detection signal according to the external condition; and a sensor output stabilizing unit coupled to an output line of the external condition detection sensor, the output line crossing the signal line, wherein the sensor output stabilizing unit comprises:

an inverter coupled to the signal line; and a capacitor coupled between an output line of the inverter and the output line.

12. The organic light emitting display device according to claim 11, wherein the signal line carries an input signal or an output signal of a scan driver.

13. The organic light emitting display device according to claim 11, wherein the external condition detection sensor comprises a light detection sensor unit configured to sense the intensity of ambient light and to output a light detection signal corresponding to the intensity of ambient light.

14. The organic light emitting display device according to claim 11, wherein the external condition detection sensor comprises a temperature detection sensor unit configured to sense ambient temperature and to output a temperature detection signal corresponding to the ambient temperature.

15. The organic light emitting display device according to claim 11, wherein a data driver controls at least one of a voltage level and a current value according to the detection signal.

16. An organic light emitting display device, comprising:

a pixel unit configured to be driven according to a signal on a signal line;

an external condition detection sensor configured to sense an external condition and to output a detection signal according to the external condition on an output line; and a sensor output stabilizing unit coupled to the output line of the external condition detection sensor, the output line capacitively coupled to the signal line, wherein the sensor output stabilizing unit is configured to compensate for parasitic coupling of the signal onto the output line.

17. The organic light emitting display device according to claim 16, wherein the signal line carries an input signal or an output signal of a scan driver.

18. The organic light emitting display device according to claim 16, wherein the external condition detection sensor comprises a light detection sensor unit configured to sense the intensity of ambient light and to output a light detection signal corresponding to the intensity of ambient light.

19. The organic light emitting display device according to claim 16, wherein the external condition detection sensor comprises a temperature detection sensor unit configured to sense ambient temperature and to output a temperature detection signal corresponding to the ambient temperature.

20. The organic light emitting display device according to claim 16, wherein a data driver controls at least one of a voltage level and a current value according to the detection signal.

* * * * *